US005383442A

United States Patent [19]

Tippmann

[11] Patent Number: 5,383,442

[45] Date of Patent: Jan. 24, 1995

[54] PUMP ACTION MARKING PELLET GUN

[76] Inventor: Dennis J. Tippmann, 12708 Parent Rd., Fort Wayne, Ind. 46809

[21] Appl. No.: 896,575

[22] Filed: Jun. 10, 1992

[51] Int. Cl.[6] ..... F41B 11/06; F41B 11/32

[52] U.S. Cl. ..... 124/76; 124/73; 124/74

[58] Field of Search ..... 124/56, 70, 71, 73, 124/74, 76

[56] References Cited

U.S. PATENT DOCUMENTS

| | | | |
|---|---|---|---|
| 433,674 | 8/1890 | D'Arcy-Irvine | 124/71 X |
| 2,307,015 | 1/1943 | Boynton | 124/73 |
| 2,574,408 | 11/1951 | Moe | 124/73 |
| 2,791,944 | 5/1957 | Harvey | 124/73 X |
| 3,612,026 | 10/1971 | Vadas et al. | 124/76 |
| 4,531,503 | 7/1985 | Shepherd | 124/76 |
| 4,819,609 | 4/1989 | Tippmann | 124/72 |
| 4,936,282 | 6/1990 | Dobbins et al. | 124/73 X |

FOREIGN PATENT DOCUMENTS

| | | | |
|---|---|---|---|
| 1377593 | 9/1964 | France | 124/76 |

*Primary Examiner*—Dennis L. Taylor
*Assistant Examiner*—John Ricci
*Attorney, Agent, or Firm*—Roger M. Rickert

[57] ABSTRACT

A compressed powered gun has a receiver with a compressed gas source fastened to one end thereof and an elongated barrel through which projectiles may be sequentially discharged fastened to the other end thereof, A clamp is formed as an integral portion of the receiver and adapted to encircle and be tightened about the barrel near one barrel end to connect the barrel to the receiver, A projectile supply hopper containing a plurality of projectiles supplies projectiles sequentially to the receiver by way of a feed tube which is formed as an integral portion of the receiver, A clamp formed as an integral portion of the feed tube is arranged to encircle and be tightened about a portion of the projectile supply hopper thereby securing the projectile supply hopper to the feed tube portion of the receiver. The gun is has a pump action with a forestock manually movable along the barrel in the direction of elongation thereof to position a projectile from the feed tube in a location within the gun to be subsequently discharged therefrom. There is a front sight supported on and movable with the movable forestock and a pocket formed in the forestock for receiving and storing a flexible cleaning rod.

19 Claims, 4 Drawing Sheets

PUMP ACTION MARKING PELLET GUN

SUMMARY OF THE INVENTION

The present invention relates generally to compressed gas powered guns and more particularly to such guns for firing relatively fragile projectiles such as tranquilizer darts or marking pellets. More specifically, the present invention provides an improved pump action paint ball gun.

A variety of guns for firing relatively fragile projectiles are known including tranquilizer guns and marking (commonly called paint ball) guns. Tranquilizer guns use a compressed gas to fire a chemically treated dart and are frequently used by veterinarians or wildlife management personnel to temporarily disable an animal without harming the animal. Marking guns use compressed gas pressure to fire a gelatinous capsule containing a marking material. The capsule breaks on impact with a target dispersing the material to mark the target where hit by the capsule. A recent popular recreational use for marking guns is in the "Survival Game", a kind of mock war where opposing sides attempt to seek out and "kill" one another by marking the opposition with a paint ball. Marking guns have also been used to segregate cattle within a herd and for a variety of other marking purposes.

In my prior U.S. Pat. No. 4,819,608, a self-loading paint ball gun selectively operable in either a fully or a semi-automatic mode is disclosed. A gravity fed paint ball supply is generally inadequate for such automated operation, but may successfully be utilized in manually loading mechanisms. My prior patented device provides a positive supply of paint balls from a spring loaded magazine. My prior device also utilizes a compressed air or $CO_2$ canister both as a propellant source and a shoulder stock for the gun. U.S. Pat. No. 4,531,503, illustrates a manually actuated paint ball gun where the barrel is moved forward and then released to slide rearwardly striking and opening a fixed air valve releasing compressed gas to power the paint ball. This last patented device employs a positive supply of paint balls from a spring loaded cylindrical magazine superimposed over the barrel. Gravity fed paint ball supply devices are also known which utilize a hopper filled with randomly arranged paint balls and which narrows near the bottom to an exit opening just slightly larger that the paint ball diameter. All of the above devices have meet with significant commercial success, but there remains a need for a reliable, manually actuated, modestly priced, easily disassembled paint ball gun.

A paint ball is a fragile and dimensionally unstable item. Humidity variations, for example, may induce variations in the ball diameter of 0.002 inches. To compensate for such changes, it is desirable to be able to substitute a barrel of a different inside diameter to accept the dimensional variations of the ball. Heretofor, such substitution has been a difficult and time consuming project. It is also desirable to be able to control or adjust the gas supplied to accelerate such paint balls and, therefor, also, control or adjust the muzzle velocity of the projectile.

Among the several objects of the present invention may be noted the provision of a paint ball gun the barrel of which may be quickly and easily changed; the provision of a reliable, manually actuated, modestly priced, easily disassembled paint ball gun; the provision of a paint ball gun with a removalbe shoulder stock connectable to the lower portion of a pistol grip portion of the receiver of the gun which shoulder stock also functions as the compressed gas supply for the gun; the provision of a paint ball gun having a simple and easily accessible velocity adjustment; and the provision of a paint ball gun having a pair of clamps formed integral with the receiver which accept screws to be tightened to attach the barrel and a paint ball supply hopper respectively. These as well as other objects and advantageous features of the present invention will be in part apparent and in part pointed out hereinafter.

In general, a compressed gas powered gun for discharging projectiles and, upon the discharge of one projectile, manually actuable to position another projectile in a location within the gun to be subsequently discharged therefrom has a main frame member or receiver with a source of a compressed gas fastened thereto and providing the dual function of a shoulder stock for the gun. Alternative locations for the compressed gas shoulder stock are suggested. A projectile supply hopper is also coupled to the receiver and contains a plurality of projectiles of a generally circular cross-sectional configuration. An elongated barrel through which projectiles may be sequentially discharged is also connected to the receiver. Projectiles from the supply hopper are sequentially aligned with the barrel by way of a feed tube which is formed as an integral portion of the receiver. A pair of clamps are formed as integral portions of the receiver, one as an integral portion of the feed tube for securing the projectile supply hopper to the feed tube portion of the receiver, and the other as an integral portion of the receiver for connecting the barrel to the receiver. The gun is of the pump action variety with a hand grip or forestock manually movable along the barrel in the direction of elongation thereof to position a projectile from the feed tube in a location within the gun to be subsequently discharged therefrom. There is a front sight supported on and movable with the movable forestock and a pocket is formed in the forestock for receiving and storing a flexible cleaning rod. Alternative velocity adjustment features are included.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
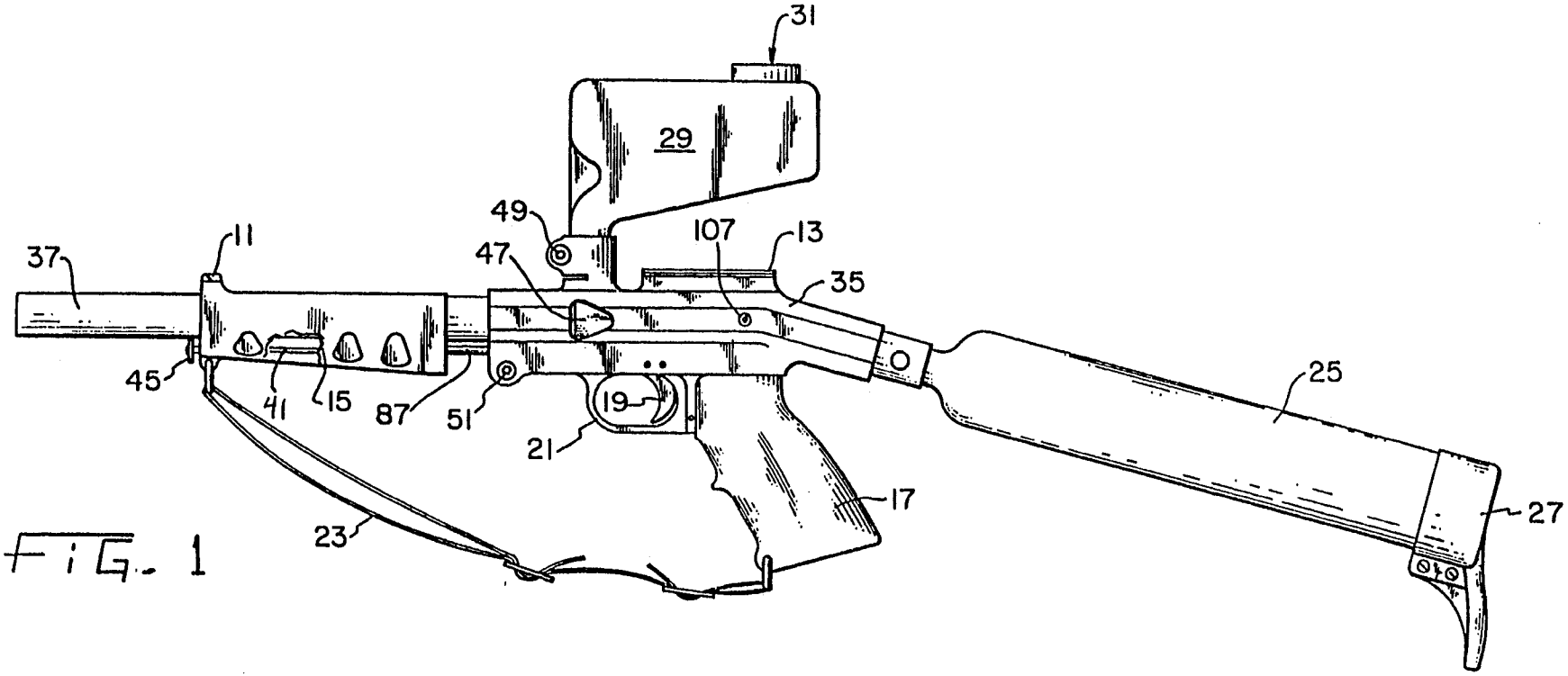
FIG. 1 is a side elevation view of a gas powered gun incorporating the present invention in one form.

Referring first to FIG. 1, many aspects of the gun are either conventional or are named by analogy with conventional parts of conventional firearms. The gun includes a front post sight 11, a rear notch sight 13, a front handgrip or forestock 15, a pistol grip 17, a trigger 19, a trigger guard 21, a sling 23, a shoulder stock 25 and buttplate 27. A paint ball supply hopper or magazine 29 is located above and, as will be understood from FIG. 4, laterally displaced out of the line of sight to a target. In FIG. 1, a $CO_2$ canister forms the shoulder stock 25. The hopper 29 is per se known and receives paint balls through an opening 31 which proceed down into an offset feed tube 33 better seen in FIG. 4. This feed tube 33 is formed as an integral part of the receiver 35. The receiver or gun frame is basically the one-piece shown in FIG. 3 if the barrel 37, trigger 19 and related small moving parts, and pistol grip handle 17 are removed.

Figure 2:
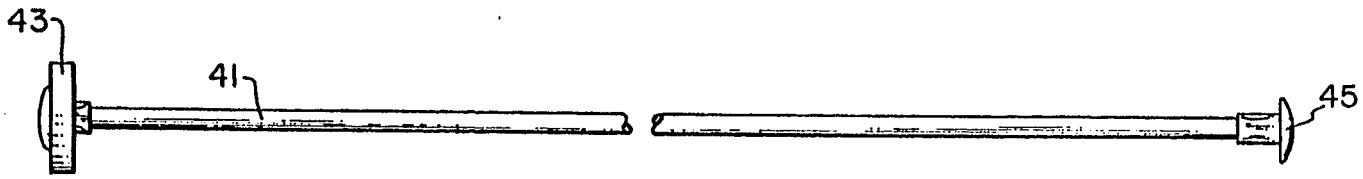
FIG. 2 is a side elevation view of a flexible cleaning rod which is stowed in the forestock of the gun of FIG. 1.

FIG. 2 shows a flexible cleaning rod 41 having a handle 43 and cleaning "patch" 45. The handle end of the rod may be inserted through the breach opening 47, through the barrel and out the muzzle end of barrel 37, and the patch 45 drawn through the barrel toward the left as viewed to clean the barrel 37. The cleaning rod is flexible and may doubled and stowed in a pocket in the pump hand grip 15.

Figure 3:
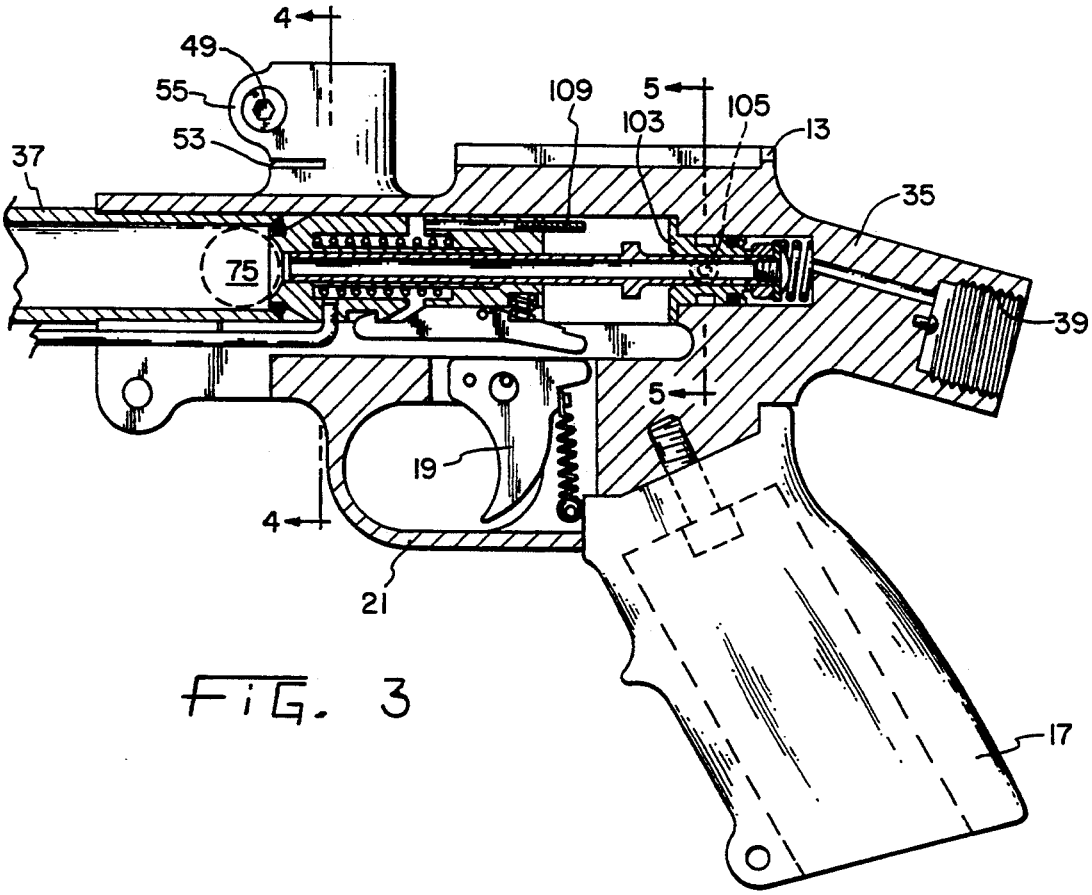
FIG. 3 is a cross-sectional view of the receiver and related parts of the gun of FIG. 1.

In FIG. 3, the $CO_2$ canister or other compressed gas source 25 has been unscrewed from the internally threaded fitting 39 of conventional valve opening design. In FIGS. 1 and 3 two pinch bolts 49 and 51 are shown which function to tighten or crimp slotted solid portions of the receiver 35 about the lower end of the ball feed hopper 29 and barrel 37 respectively. Thus, the whole gun is "field strippable" by merely loosening these two bolts. The respective pinch bolts function when tightened to pull together the free ends of a corresponding clamp formed as an integral portion of the receiver for connecting the barrel 37 or the hopper 29 to the receiver. The two clamps are substantially alike. Comparing FIGS. 3 and 4, a slot 53 frees a pair of ends 55 and 57 which are pulled toward one another to tightly encircle and grip the lower portion of the hopper 29 when bolt 49 is tightened.

Figure 4:
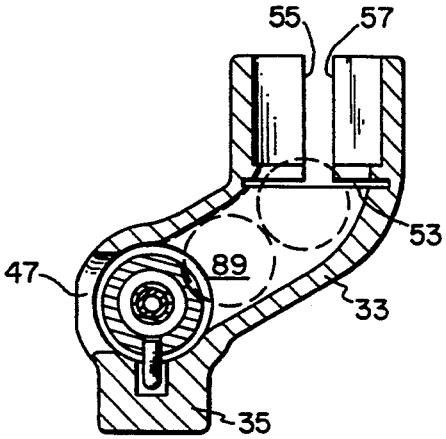
FIG. 4 is a view in cross-section along line 4—4 of FIG. 3.
Figure 5:
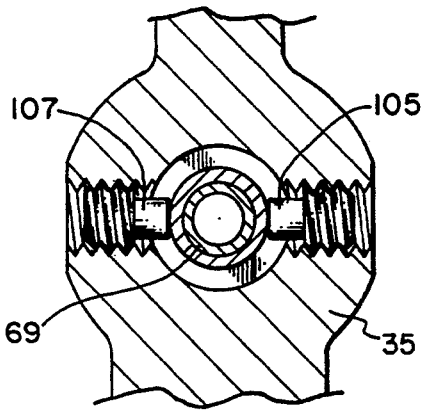
FIG. 5 is a view in cross-section along line 5—5 of FIG. 3.
Figure 6A:
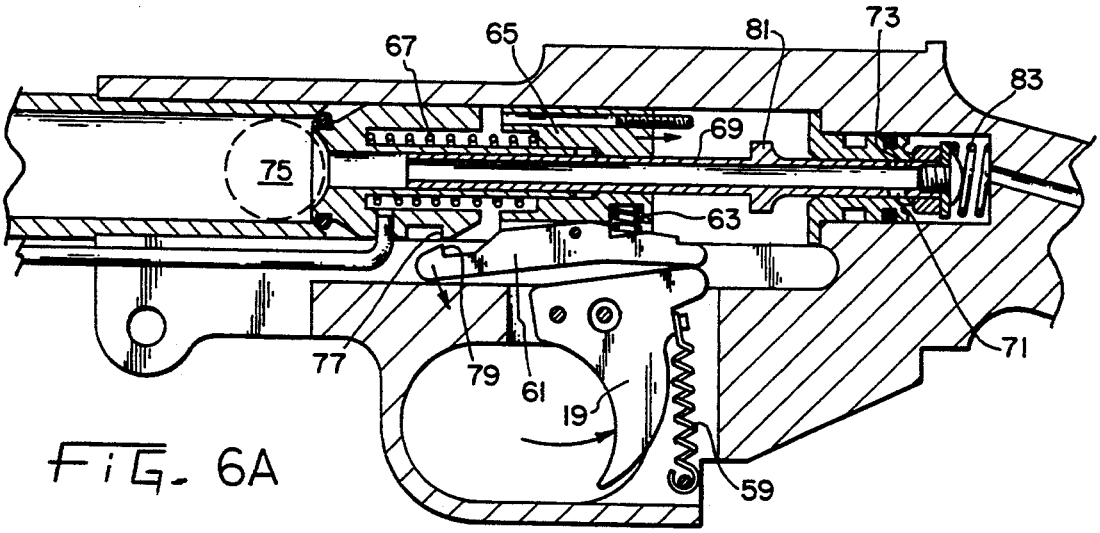
FIGS. 6A–6C are views of a portion of the receiver of FIG. 3 illustrating sequential operation of the firing mechanism.
Figure 6B:
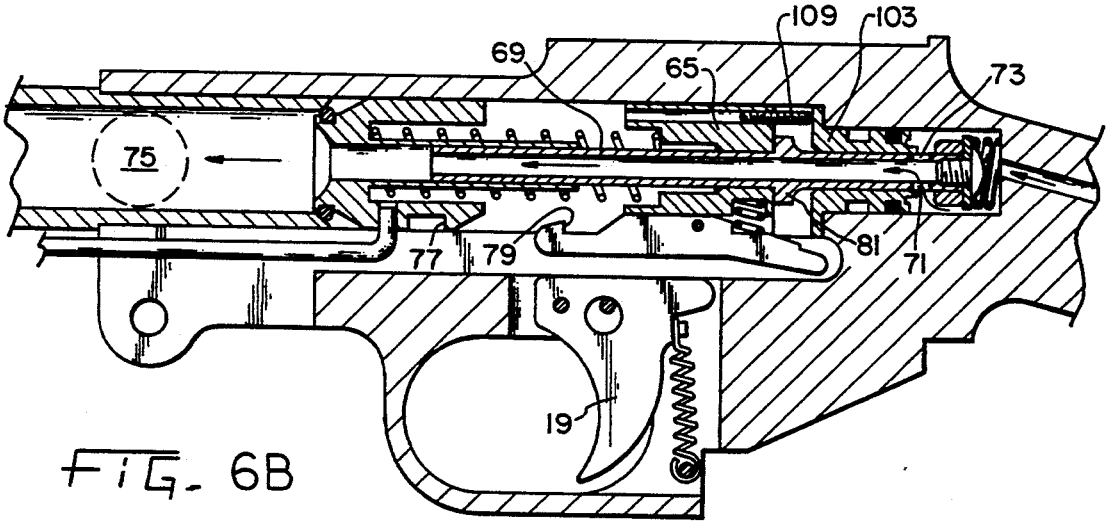
Figure 6C:
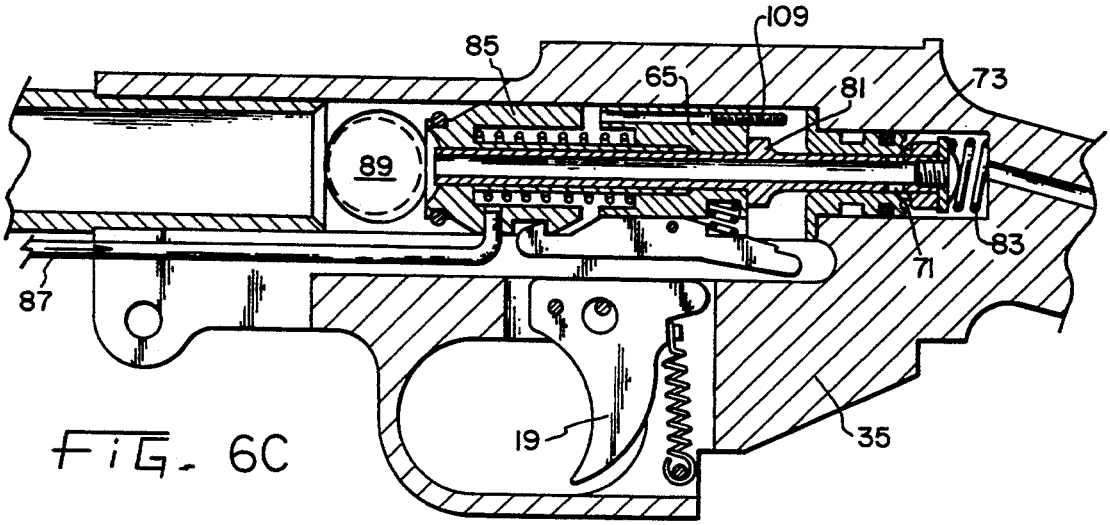

The internal mechanism is seen to include, in addition to a user actuable trigger 19, trigger return spring 59, sear 61, sear return spring 63, and a spring loaded slide or striker 65 which is released to move rearwardly (toward the right as viewed) under the urging of coil spring 67 upon user actuation of the trigger 19. In FIG. 3, the gun is loaded ready to fire paint ball 75. When the trigger 19 is pulled, sear 61 pivots counterclockwise as viewed to release the latched notches 77 and 79. Sear 61 moves rearwardly with slide 65 and when the slide strikes the shoulder 81, tube 69 is driven rearwardly against the urging of coil spring 83 to open gas ports 71 and 73 allowing gas from the canister 25 to enter the tube 69 and move forward to propel the paint ball 75 from the barrel (compare FIGS. 6A and 6B). Spring 83 recloses ports 71 and 73, but the slide 65 remains at its rearmost position as shown in FIG. 6C. The individual paint balls assume a single file order as they enter the feed tube 33 as seen in FIG. 4 and a new paint ball is presented to the barrel as the slide portion 85 clears the receiver opening. When the user pulls on the forestock 15, rod 87 and slide portion 85 are pulled toward the rear of the receiver re-engaging the notches 77 and 79, and allowing the next paint ball 89 to fall into position in the receiver as seen in FIG. 6C. When the user returns the forestock to its forward position, the slides 65 and 85 locked together by notches 77 and 79 are pulled back to the ready to fire positions of FIG. 3.

Figure 7:
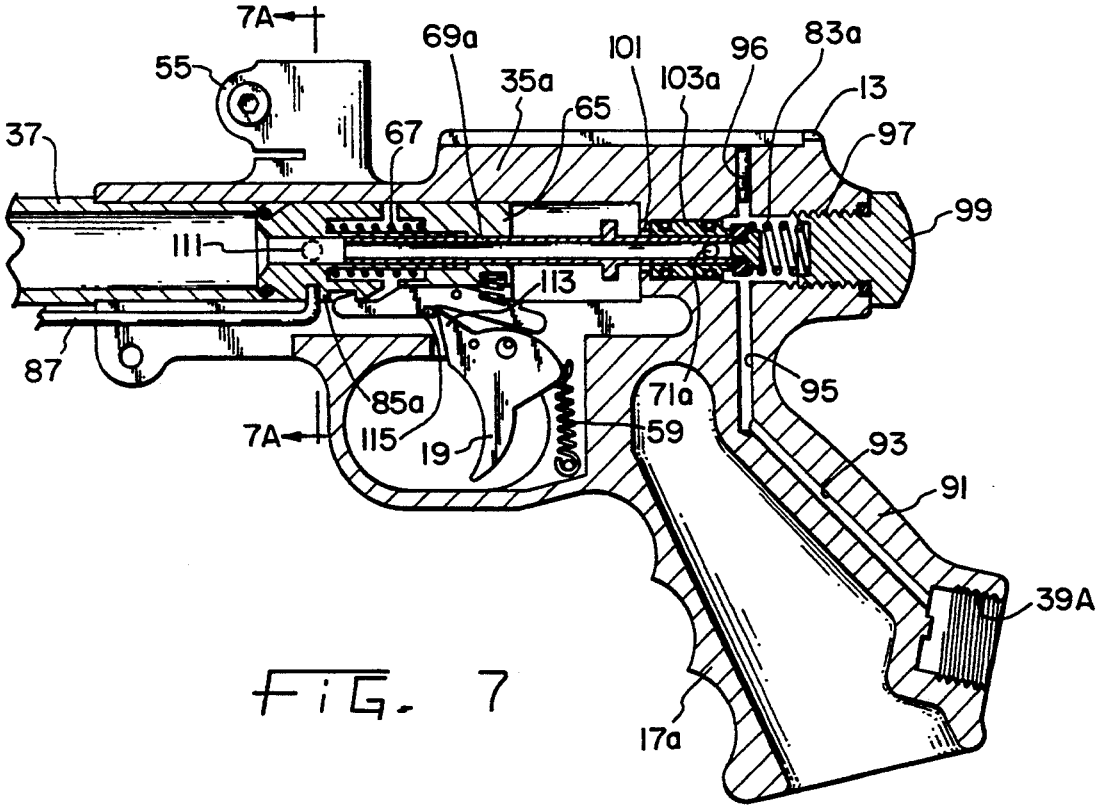
FIG. 7 is a view in cross-section similar to FIG. 3, but illustrating several modifications to the gas powered gun.
Figure 7A:
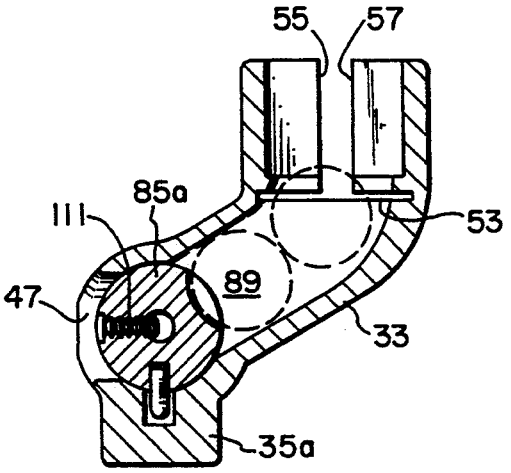
FIG. 7A is a view in cross-section along line A—A of FIG. 7.

Several modifications to the compressed gas powered gun as thus far discussed are illustrated in FIG. 7. Slightly modified, but similarly functioning parts in FIG. 7 have been assigned the reference numeral of their earlier counterparts with an "a" thereafter while unchanged parts have the same reference numeral as earlier. Comparing FIGS. 3 and 7, it will first be noted that the hand grip **17*a* is formed as an integral part of the receiver 35*a*. Comparing FIGS. 3 and 7, it will also be noted that the threaded portion 39 that receives the canister 25 has been lowered to a position 39*a* near the base of piston grip portion 91 of the receiver. A gas passageway 93 is drilled upwardly along the grip portion 91 and a connecting gas passageway 95 is drilled downwardly from the top of the receiver. The downwardly drilled hole is subsequently sealed as by a plug 96. This lowering of the tank 25 has been found to be desirable to aid users wearing protective face masks to aim the gun. Such protective face masks may otherwise interfere with the user positioning his head to properly use the rear notch sight 13. With the compressed gas tank 25 no longer attached to the rear portion of the receiver 35, the hole 39 need not be canted (its axis misaligned with the barrel axis) as shown in FIG. 3 and a threaded hole 97 which receives a sealing plug 99 may be drilled straight through the receiver in alignment with the barrel 37 to facilitate assembly. The receiver of FIG. 7 includes a shoulder 101 which holds the sealing plug 103*c*. In particular, the parts including the spring 83 which were previously inserted from the front end of the receiver where the barrel attaches are now passed through the rear end and the plug 99 inserted to hold the parts and seal the receiver gas chamber. The rear sealing plug 103 in FIG. 3 is held in place by a pair of allen screws 105 and 107, but in FIG. 7, the similar sealing plug 103*a* is simply pushed against the shoulder 101 by spring 83*a***.

Returning to FIGS. 6A–6C, a velocity adjustment feature is included in the form of the set screw 109 which limits the rearward travel of the slide 65 by, as seen in FIG. 6B, hitting the sealing plug 103. With the rearward travel limited, the distance the tube 69 moves, and thus, the time the port 71 is open is limited, and therefor also the charge of gas released to propel the projectile is limited. For example, moving the set screw 109 toward the left relative to the slide 65 will allow the slide to move further rightward when trigger 19 is pulled. This additional rightward movement, in turn, drives tube 69 further to the rear of the gun. Hence, aperture 71 remains open longer and more gas is released causing the projectile to be accelerated to a greater velocity that before. Such an adjustment feature is highly desirable to get optimum performance from the gun under varying ambient conditions. It was noted earlier that two pinch bolts 49 and 51 are shown which function to tighten or crimp slotted solid portions of the receiver 35 about the lower end of the ball feed hopper 29 and barrel 37 respectively and that the whole gun is "field strippable" by merely loosening these two bolts. Since bolt 49 functions solely to hold the hopper 29 in place, field stripping to clean the mechanism is actually accomplished by loosening the single bolt 51. Also, to make a velocity adjustment to the gun of FIGS. 3 and 6, this screw 51 must be removed, and the barrel 37 and slide portion 85 removed to gain access to the screw 109 through the muzzle end of the receiver. Quick and easy access to a velocity adjustment to, for example, reduce projectile velocity as the day progresses and outside temperature increases, is a highly desirable feature and is achieved with the modified gun of FIG. 7. It should be pointed out, however, that the rear plug 99 must be removed in addition to loosening the bolt 51 to field strip the gun of FIG. 7, a small price to pay for the enhanced ease of velocity adjustment.

In FIGS. 7 and 8, the slide portion 85*a* which ports gas from the supply line 95 forward through hollow tube 69*a* to propel the projectile has a set screw 111 movable transverse to the longitudinal axis of the gun to variably restrict the gas passing aperture or opening through the slide portion 85*a* and, therefor, the amount of gas supplied on each firing to the projectiles. This set screw 111 is easily accessible with a standard allen wrench through the breach opening 47 (FIG. 1) to adjust projectile velocity.

A sometimes desirable feature is "rapid fire" wherein the trigger is simply held back to always clear the sear while the pump is repeatedly actuated and a projectile fired on each such actuation. The gun of FIGS. 1–6 can be repeatedly pumped with the trigger held in the depressed position for such "rapid fire." An inexperienced user may actuate the pump handle 15 of the gun of FIGS. 1–6 several times without pulling trigger 19 thereby filling the breach end of the barrel 37 with several projectiles. When the trigger is finally actuated, there is too much mass accumulated in the barrel to be expelled from the muzzle end of the barrel properly and projectiles may rupture or the gun otherwise malfunction. FIG. 7 embodiment avoids this problem by providing a breech lock system including the trigger pin 113 and sear notch 115. A single operation of the pump action mechanism results in the pin 113 engaging the notch 115 to prevent a second operation of the pump handle. As the trigger is pulled, this pin 113 clears the notch 115 before the interlocked notches 77 and 79 (FIGS. 6A and 6B) separate releasing the slide portion 65 and discharging the projectile. The gun can still be repeatedly pumped with the trigger held in the depressed position for "rapid fire."

From the foregoing, it is now apparent that a novel gas powered pump action projectile firing gun has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A compressed gas powered gun for discharging relatively fragile projectiles and, upon the discharge of one projectile, manually actuable to position another projectile in a location within the gun to be subsequently discharged therefrom comprising:

a receiver;

a compressed gas source fastened to the receiver;

a projectile supply hopper coupled to the receiver and containing a plurality of projectiles, each projectile having a generally circular cross-sectional configuration;

an elongated barrel connected to the receiver through which projectiles may be sequentially discharged;

means including a user actuable trigger for selectively supplying compressed gas from the source to expel a projectile through the barrel;

means for sequentially aligning projectiles from the supply hopper with the barrel including a feed tube formed as an integral portion of the receiver and a slide portion reciprocable within the receiver between a first position to allow a projectile to pass from the feed tube into alignment with the barrel, and a second position to prevent a projectile from passing from the feed tube into alignment with the barrel; and a forestock coupled to the slide portion of the means for sequentially aligning and manually movable along the barrel in the direction of elongation thereof to position a projectile from the feed tube in a location within the gun to be subsequently discharged therefrom.

2. The compressed gas powered gun as set forth in claim 1 further comprising a clamp formed as an integral portion of the feed tube for securing the projectile supply hopper to the feed tube portion of the receiver.

3. The compressed gas powered gun as set forth in claim 1 further comprising a clamp formed as an integral portion of the receiver for connecting the barrel to the receiver.

4. The compressed gas powered gun as set forth in claim 1 further comprising a front sight supported on and movable with the movable forestock.

5. The compressed gas powered gun as set forth in claim 1 further comprising a flexible cleaning rod and a pocket formed in the forestock for receiving and storing the flexible cleaning rod.

6. A compressed gas powered gun for discharging projectiles and, upon the discharge of one projectile, manually actuable to position another projectile in a location within the gun to be subsequently discharged therefrom comprising:

a receiver;

a compressed gas source fastened to the receiver;

a projectile supply comprises a hopper containing a plurality of projectiles, each projectile having a generally circular cross-sectional configuration;

an elongated barrel through which projectiles may be sequentially discharged;

a first clamp formed as an integral portion of the receiver and adapted to encircle and be tightened about the barrel near one end thereof to connect the barrel to the receiver;

a feed tube formed as an integral portion of the receiver and a second clamp formed as an integral portion of the feed tube, the second clamp adapted to encircle and be tightened about a portion of the projectile supply hopper thereby securing the projectile supply hopper to the feed tube portion of the receiver;

means including a user actuable trigger for selectively supplying compressed gas from the source to expel a projectile through the barrel; and means for sequentially aligning projectiles from the supply with the barrel.

7. The compressed gas powered gun as set forth in claim 6 wherein the means for sequentially aligning includes a first slide portion reciprocable within the receiver between a first position to allow a projectile to pass from the projectile supply into alignment with the barrel, and a second position to prevent a projectile from passing from the projectile supply into alignment with the barrel, and further comprising a forestock coupled to the first slide portion of the means for sequentially aligning and manually movable along the barrel in the direction of elongation thereof to position a projectile from the feed tube in a location within the gun to be subsequently discharged therefrom.

8. The compressed gas powered gun as set forth in claim 7 further comprising a front sight supported on and movable with the movable forestock.

9. The compressed gas powered gun as set forth in claim 7 further comprising a flexible cleaning rod and a pocket formed in the forestock for receiving and storing the flexible cleaning rod.

10. The compressed gas powered gun as set forth in claim 6 wherein the means for selectively supplying includes a valve for controlling the release of compressed gas from the source to expel a projectile, a valve opening member which travels in the direction of barrel elongation when released by actuation of the trigger by a user, and an adjustment screw for selectively controlling the quantity of compressed gas supply from the source to expel a projectile through the barrel, the adjustment screw limiting the travel of a valve opening member thereby limiting the quantity of gas allowed to propel the projectile and controlling the velocity of the projectile as it exits the barrel.

11. The compressed gas powered gun as set forth in claim 6 wherein the means for selectively supplying includes an adjustment screw for selectively controlling the quantity of compressed gas supplied from the source to expel a projectile through the barrel, thereby controlling the velocity of the projectile as it exits the barrel, the adjustment screw restricting a gas passing aperture thereby limiting the quantity of gas allowed to propel the projectile.

12. The compressed gas powered gun as set forth in claim 6 further comprising a bolt passing through the clamp for tightening the clamp and holding the barrel in place within the receiver.

13. A compressed gas powered gun for discharging projectiles and, upon the discharge of one projectile, manually actuable to position another projectile in a location within the gun to be subsequently discharged therefrom comprising:

a receiver having an integrally formed pistol grip portion;

a compressed gas source fastened to the pistol grip portion of the receiver;

a projectile supply containing a plurality of projectiles, each projectile having a generally circular cross-sectional configuration;

an elongated barrel through which projectiles may be sequentially discharged;

means including a user actuable trigger and a gas passing aperture for selectively supplying compressed gas from the source to expel a projectile through the barrel;

means for sequentially aligning projectiles from the supply with the barrel.

14. A compressed gas powered gun for discharging relatively fragile projectiles and, upon the discharge of one projectile, actuable to position another projectile in a location within the gun to be subsequently discharged therefrom comprising:

a receiver;

a compressed gas source fastened to the receiver;

a projectile supply coupled to the receiver and containing a plurality of projectiles, each projectile having a generally circular cross-sectional configuration;

an elongated barrel through which projectiles may be sequentially discharged; and means including a user actuable trigger for selectively supplying compressed gas from the source to expel a projectile through the barrel;

the means for selectively supplying including a gas passing aperture located intermediate the barrel and the compressed gas source and an adjustment screw for variably restricting the size of the gas passing aperture thereby selectively controlling the quantity of compressed gas supplied from the source to expel a projectile through the barrel, and therefor also controlling the velocity of the projectile as it exits the barrel.

15. The compressed gas powered gun as set forth in claim 14 wherein the adjustment screw restricts a gas passing aperture thereby limiting the quantity of gas allowed to propel the projectile.

16. A compressed gas powered gun for discharging projectiles and, upon the discharge of one projectile, manually actuable to position another projectile in a location within the gun to be subsequently discharged therefrom comprising:

a receiver;

a compressed gas source fastened to the receiver;

a projectile supply coupled to the receiver and containing a plurality of projectiles, each projectile having a generally circular cross-sectional configuration;

an elongated barrel through which projectiles may be sequentially discharged;

means including a user actuable trigger for selectively supplying compressed gas from the source to expel a projectile through the barrel;

means for sequentially aligning projectiles from the supply with the barrel including first and second slide members reciprocable within the receiver, the first slide member being reciprocable within the receiver between a first position to allow a projectile to pass from the projectile supply into alignment with the barrel, and a second position to prevent a projectile from passing from the projectile supply into alignment with the barrel, and a forestock fixed to the first slide member and manually operable to move along the barrel in the direction of elongation thereof to correspondingly move the first slide member and align a projectile with the barrel; and means including the manually operable trigger for precluding operation of the forestock after one projectile is aligned with the barrel until the user operated trigger is actuated to expel that one projectile.

17. The compressed gas powered gun as set forth in claim 16 further comprising an adjustment screw for selectively controlling the quantity of compressed gas supplied from the source to expel a projectile through the barrel by selectively varying a restriction in a gas passing aperture thereby limiting the quantity of gas supplied to, and controlling the velocity of, the projectile as it exits the barrel.

18. The compressed gas powered gun as set forth in claim 16 wherein the means for selectively supplying compressed gas from the source includes a sear supported on the second slide member for selectively interlocking the first and second slide members together, the sear being responsive to actuation of the trigger to separate the second slide member from the first slide member; and the means for precluding operation of the means for sequentially aligning projectiles includes means selectively interlocking the sear and trigger to prevent reciprocation of the first and second slide members.

19. The compressed gas powered gun as set forth in claim 18 further comprising an adjustment screw located in the first slide member for selectively controlling the quantity of compressed gas supplied from the source to expel a projectile through the barrel by selectively varying a restriction in a gas passing aperture thereby limiting the quantity of gas supplied to, and controlling the velocity of, the projectile as it exits the barrel.

* * * * *